US008393790B2

(12) United States Patent
Deutsch et al.

(10) Patent No.: US 8,393,790 B2
(45) Date of Patent: Mar. 12, 2013

(54) LIGHT METAL FEED BEAM FOR USE ON A DRILL RIG

(75) Inventors: René Deutsch, Órebro (SE); Dan Jonsson, Sköllersta (SE)

(73) Assignee: Atlas Copco Rock Drills AB, Orebro (SE)

( * ) Notice: Subject to any disclaimer, the term of this patent is extended or adjusted under 35 U.S.C. 154(b) by 534 days.

(21) Appl. No.: 11/921,036

(22) PCT Filed: May 23, 2006

(86) PCT No.: PCT/SE2006/050153

§ 371 (c)(1),
(2), (4) Date: Nov. 26, 2007

(87) PCT Pub. No.: WO2007/004969

PCT Pub. Date: Jan. 11, 2007

(65) Prior Publication Data

US 2009/0080815 A1 Mar. 26, 2009

(30) Foreign Application Priority Data

Jun. 30, 2005 (SE) ..... 0501518

(51) Int. Cl.
*F16C 33/00* (2006.01)
*F16C 33/02* (2006.01)

(52) U.S. Cl. ..... 384/42; 384/39

(58) Field of Classification Search ..... 384/7, 26, 384/30, 31, 35, 39, 41, 42, 55, 59
See application file for complete search history.

(56) References Cited

U.S. PATENT DOCUMENTS

| | | | | |
|---|---|---|---|---|
| 4,682,899 | A * | 7/1987 | Andersson et al. | 384/41 |
| 4,941,197 | A | 7/1990 | Roeser | |
| 5,549,390 | A * | 8/1996 | Reitberger | 384/44 |
| 5,704,716 | A * | 1/1998 | Jantunen | 384/41 |
| 6,190,047 | B1 * | 2/2001 | Haag et al. | 384/55 |
| 6,293,269 | B1 | 9/2001 | Selb et al. | |
| 6,472,778 | B2 * | 10/2002 | Keller | 310/12.32 |
| 2004/0255709 | A1 | 12/2004 | Reitberger | |

FOREIGN PATENT DOCUMENTS

| | | | |
|---|---|---|---|
| EP | 0 159 974 | | 10/1985 |
| WO | 9518912 | | 7/1995 |
| WO | WO2004074626 | * | 9/2004 |
| WO | WO 2006/098674 | | 9/2006 |

OTHER PUBLICATIONS

Printout from website www.doofor.com, Printed Nov. 15, 2010.

* cited by examiner

*Primary Examiner* — James Pilkington
(74) *Attorney, Agent, or Firm* — Mark P. Stone

(57) ABSTRACT

The invention relates to an elongated feed beam (4) for use on a drill rig (1), which feed beam comprises a profiled beam of a light metal or a light metal alloy made from a hollow extruded profile with a substantially rectangular cross section. The profiled beam comprises an upper wall (11), a lower wall (12) and two side walls (13, 14) and at least one pair of external guide beads (8, 9). The individual guide beads (8, 9) of the at least one pair of guide beads are placed on either side of either the upper wall (11) or the lower wall (12) at the locations where said upper or lower wall (11, 12) meets the opposed side walls (13, 14). The guide beads (8, 9) have a substantially prismatic cross section.

15 Claims, 2 Drawing Sheets

LIGHT METAL FEED BEAM FOR USE ON A DRILL RIG

TECHNICAL FIELD OF THE INVENTION

The present invention relates to a light metal feed beam for use on a drill rig, in accordance with the preamble of the independent claim. The invention also relates to a drill rig comprising such a feed beam.

BACKGROUND OF THE INVENTION

Generally (see FIG. 1), a rock drill rig comprises a movable carrier 1, a boom 2 and a feed beam 4 connected to the boom 2 via a feed beam holder 3. The feed beam 4 and the feed beam holder 3 are movable in relation to each other along at least part of the length of the feed beam. A drilling machine 5 is movably arranged on the feed beam 4.

One of the most important features of a drill rig is its durability and reliability. All parts of the equipment need to answer to the high demands that are required in the extreme working operations of a drill rig. It is also important that its accuracy can be withheld under these conditions. Therefore, improvements that ameliorate the endurance, accuracy and reliability of the equipment is always sought for. One of the parts that are put under a lot of stress is the feed beam 4.

From EP 0 159 974 B1 it is known to use an extruded light metal feed beam on a drill rig, which feed beam includes guides for guiding a rock drill. An extruded feed beam of light metal has the advantage of being both lighter and straighter than a conventional steel beam. Additionally, there exists a bigger liberty in the design of the extruded aluminium feed beam than for a conventional steel beam. A disadvantage is that aluminium is weaker than steel and that the feed beam has to be made thicker than a conventional steel beam. The feed beam used in EP 0 159 974 B1 is of the open, channel beam type.

In the international patent application No PCT/SE2006/000244 a novel arrangement with a pressure cylinder inside the feed beam provides for the possibility to use a closed box beam instead of a conventional open channel beam.

The closed feed beam of the box beam type is advantageous as it has a higher structural strength than the open channel beam of a corresponding thickness. It can therefore be made both lighter and stronger than a conventional feed beam.

It is suggested on the Internet home page of Doofor rock drills (http://www.doofor.com/products/feedbeam.htm) available on Jun. 29, 2005, that closed, so called box beams may be used as aluminium feed beams. The feed beam presented on the Doofor home page is only a schematic illustration showing only a few constructional details.

BRIEF DESCRIPTION OF THE INVENTION

The main object of the present invention is to achieve a light metal feed beam, which is in the form of a box beam and which is well suited for use as feed beam. This is solved by the features set forth in the characterising portion of the independent claim.

Preferred embodiments of the invention are set forth in the dependent claims.

According to a main aspect, the present invention relates to an elongated feed beam for a rock drill, comprising a profiled beam of a light metal or a light metal alloy made from a hollow extruded profile with a substantially rectangular cross section with an upper wall, a lower wall and two side walls.

The feed beam includes at least one pair of external guide beads. The individual guide beads are placed on either side of either the upper wall or the lower wall where said upper or lower wall meets the opposed side walls. Further, the guide beads have a substantially prismatic cross section.

The feed beam according to the invention is both lighter and stronger than conventional feed beams. Additionally, it has a shape that is well adapted to withstand operational efforts without the use of excessive material.

These and other aspects and advantages of the present invention will be apparent from the detailed description and the accompanying drawings.

SHORT DESCRIPTION OF THE DRAWINGS

In the detailed description of the present invention reference is made to the accompanying drawings, wherein.

DETAILED DESCRIPTION

Figure 1:
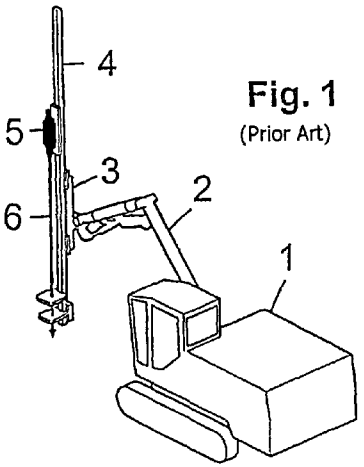
Fig. 1 (Prior Art)
FIG. 1 is a schematic view of a rock drill rig.

As briefly discussed above, FIG. 1 shows a schematic view of a rock drill rig comprising a movable carrier 1, a boom 2 and a feed beam 4 connected to the boom 2 via a feed beam holder 3. The feed beam 4 and the feed beam holder 3 are movable in relation to each other along at least part of the length of the feed beam 4. A drilling machine 5 is movably attached to the feed beam 4, and is movable along the feed beam 4 to affect the drill string 6. The drill string 6 comprises the drill point (drill bit) and joined rods (not shown). Other equipment attached to the feed beam 4, may be equipment for e.g. rod handling.

Figure 2:
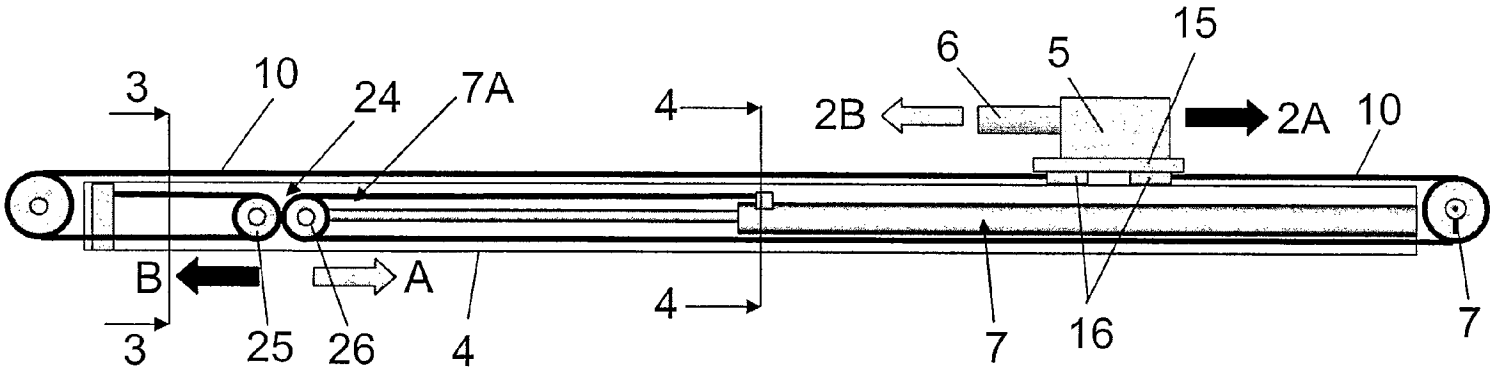
FIG. 2 is side view of a feed beam according to a preferred embodiment of the invention, partly in cross section and with a pressure cylinder arranged inside.
Figure 4:
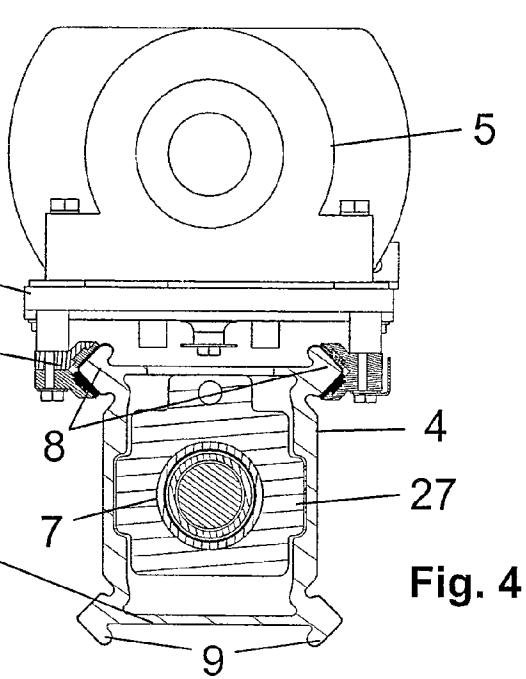
FIG. 4 is a view partly in cross section of a feed beam according to the invention, taken along line 4-4 in FIG. 2.
Figure 3:
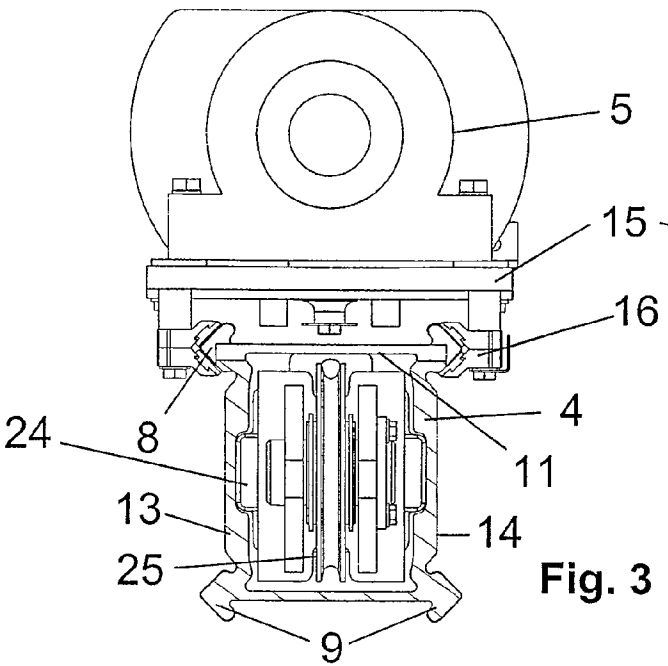
FIG. 3 is a view partly in cross section of a feed beam according the invention, taken along line 3-3 in FIG. 2.

Now with reference to FIGS. 2, 3 and 4, the general operation of the feed beam 4 will be described. According to an exemplary embodiment of the invention a pressure cylinder 7 is arranged inside the feed beam 4. The pressure cylinder 7 is arranged for providing the feeding of the drilling machine 5. The drilling machine is arranged on a sled 15 with sliding elements 16 that are slidably arranged on a first pair of guide beads 8 on the exterior of the feed beam 4. A second pair of guide beads 9 are preferably arranged on the opposite side of the feed beam 4. Due to these guide beads 9 the feed beam may be slidably arranged in a feed beam holder 3 (see FIG. 1). Normally, the feed beam holder 3 and the feed beam 4 are only adjusted with regard to each other when the feed beam is brought into a correct drilling position before the drilling operation is under way, whereas the drilling machine 5 normally travels up and down the guide beads 8 on the opposite side of the feed beam 4 continuously throughout the drilling operation.

In this specific embodiment a feed line 10, which is affected by the pressure cylinder 7 inside the feed beam, drives the drilling machine 5 such that it moves in accordance with the arrows A, B when the pressure cylinder is retracted A or extended B. The feed line 1 is arranged such that a given distance that the free end 7A of the pressure cylinder 7 is moved implies that the drilling machine 5 is moved twice that distance. This is described more in detail in the international application PCT/SE2006/000244, and will not be described further herein.

Figure 5:
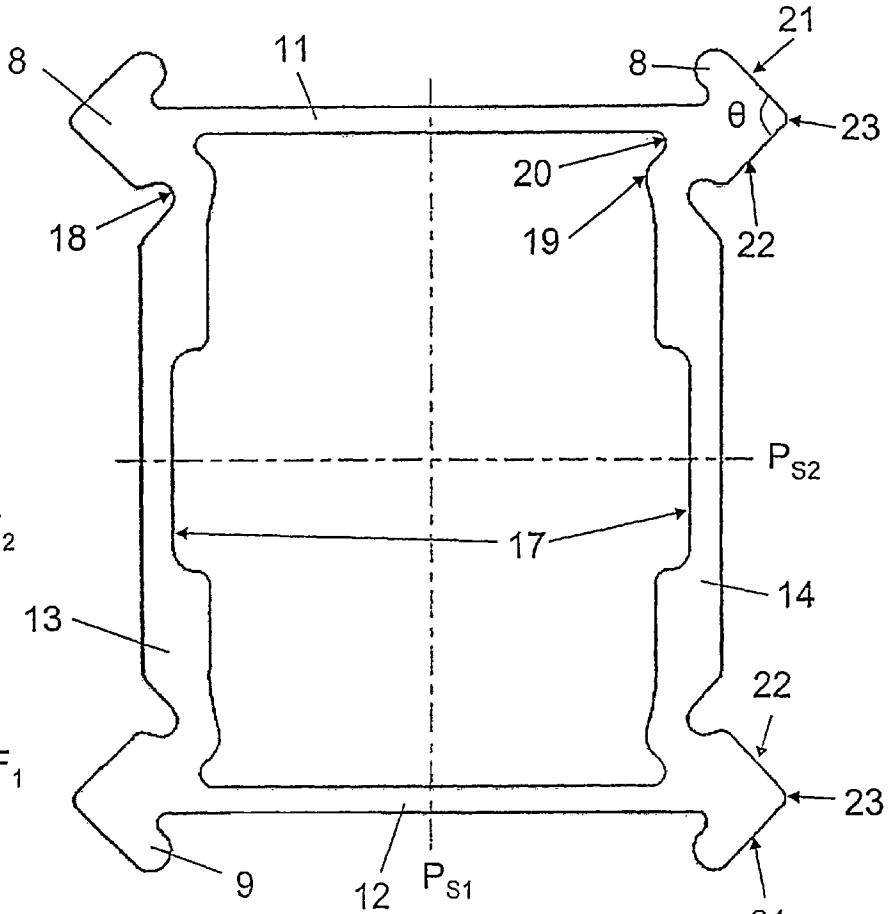
FIG. 5 is a cross sectional view of a feed beam according to a preferred embodiment of the invention.

Now, with reference to FIG. 5 the cross section of the feed beam according to the preferred embodiment of the invention will be described, as well as some of its benefits. The elongated feed beam according to the invention is made from a hollow extruded profile of a light metal or a light metal alloy with a substantially rectangular cross section. It has an upper wall 11, a lower wall 12 and two side walls 13, 14. As shown in FIG. 5 of the drawing, the walls 11, 12, 13 and 14 have substantially planar outer surfaces. The rectangular cross section of the feed beam 4 has a first plane of symmetry $Ps_1$ that intersects the centre of the upper wall 11 and lower wall 12 such that the side walls 13, 14 constitute mirror images of each other. It may also have a second plane of symmetry $Ps_2$ that intersects the centre of the side walls 13, 14 such that the upper and lower walls 11, 12 are mirror images of each other. It further includes at least one pair of external guide beads 8, 9. One pair 8 for guiding the movement of the drilling machine 5, or a sled 15 on which the drilling machine 5 is placed, along the feed beam, and one pair 9 for guiding the movement of the feed beam 4 with respect to a feed beam holder 3.

The whole structure of the feed beam is designed for operational conditions. The fact that the beam 4 has four walls instead of three walls as in the conventional open, channel beam described in EP 0 159 974 B1 of course makes it much stronger. Due to the upper wall 11, the side walls 13, 14 are put under a lot less stress than the side walls of a conventional channel beam and may correspondingly be made thinner. Beyond this, the inside corners of the beam are shaped in a form that is intended to meet two important requirements. Firstly they need to be sufficiently rigid to withstand the forces that the beam is exposed to from the drilling machine and secondly they should not be made to solid, i.e. any excessive use of material should be avoided. With the corners according to the preferred embodiment of the present invention, the rigidity of the beam is high enough, even though less material is used than for many conventional open channel beams.

The guide beads 8, 9 are placed on either side of either the upper wall 11 or the lower wall 12 where the upper or lower wall 11, 12 meets the opposed side walls 13, 14. Preferably, the guide beads 8, 9 have a substantially prismatic cross section and has two substantially planar support surfaces 21, 22 that are joined by an edge 23 and inclined with respect to each other with an angle θ of 45° to 100°, such that the edge 23 constitutes the outermost parts of the beads 8, 9. Preferably, the angle θ between the surfaces 21, 22 is about 90°, e.g. between 80° and 100°. Such a shape has proven very utile as it is well adapted to receiving the forces that the beads 8, 9 are put under from the drilling machine 5. It is also feasible to construct the guide beads such that their upper surfaces 21 are horizontal. This is particularly useful for small angles of θ.

Generally, during operation the drill string 6 is exposed to forces that tend to rotate the drilling machine 5 with respect to the feed beam 4. Using prismatic guide beads 8, 9 with an angle θ between the support surfaces 21, 22 of about 90°, the forces from the drilling machine will be essentially orthogonal to one of the support surfaces on both of the prismatic guide beads 8, 9, as illustrated by $F_1$ and $F_2$ in FIG. 6. This is advantageous for the absorption of the forces. Further the corner structure of the beam according to the preferred embodiment is shaped such that it is well adapted to withstand stress situations that are likely to occur under operation.

In the elaboration of the shape the corners, a number of different types were initially suggested. Tensions were calculated for anticipated operational stress situations, e.g. $F_1$ and $F_2$ in FIG. 6, on these different types of corner structures. From the calculations on these structures it was clear that the corner structure of the preferred embodiment gave rise to small tensions in a critical area, illustrated by σ in FIG. 6, both on the inside and the outside of the side wall. It was specifically advantageous in view of a tension per material ratio, which will be briefly discussed below. Therefore, this structure has been chosen for the preferred embodiment according to this invention.

Figure 6:
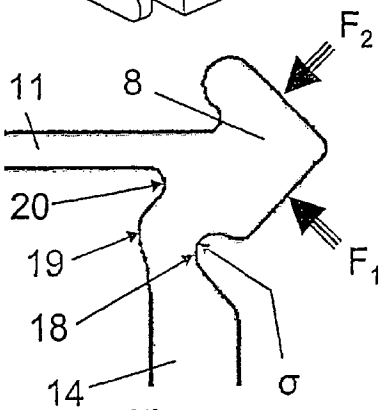
FIG. 6 is a partial view of a feed beam shown in FIG. 5.

As is evident in FIGS. 5 and 6, the preferred embodiment involves external longitudinal recesses 18 that extend alongside the guide beads 8, 9 on both side walls 13, 14. These recesses 18 define a groove between the side walls 13, 14 and the guide beads 8, 9. The recesses 18 ameliorate the accessibility of the guide beads and due to the recesses the guide beads are essentially integral with the feed beam structure and still accessible to the sliding elements 16 of the drilling machine 5, at one end, or the beam holder 3, at the other end (see FIG. 1). In general and in order to protect the guide beads 8, 9, bent plates (not shown) are arranged on the guide beads such that the support surfaces 21, 22 are covered. Bent plates of this kind are described in EP 0 159 974 B1. Due to the recesses 18, the bent plates may easily be snapped onto the guide beads. The bent plates will be more closely discussed below.

Opposite the recesses 18 mentioned above, on the other side of the respective side wall 13, 14, internal longitudinal bulges 19 extend. These bulges 19 are located such they at least partly overlap the external longitudinal 18 recesses. The bulges 19 make up for the lost of material on the outside of the side walls 13, 14 implied by the recesses 18 and preferably the width of the side wall 13, 14 is substantially invariable over this passage such that no specifically weak point is formed in the cross section of the feed beam 4.

Additionally, as a way of saving material essentially without affecting the rigidity of the feed beam 4, internal longitudinal recesses 20 extend inside the feed beam on both side walls, which recesses are located such that they at least partly overlap the guide beads 8, 9. The reduced wall width due to loss of material implied by these recesses 20 are in other words compensated for by the additional width of the side wall provided by the guide beads 8, 9. It is important that the surface of the feed beam is substantially smooth and flat as any defects or edged shapes may act as starting points for cracks and weaken the general structure. Therefore, all corners or details are well rounded and, in addition, polished.

Also, in the preferred embodiment of the invention, the guide beads 8, 9 are solid. It would of course be possible to produce hollow guide beads, as has been the case in prior art. However, as the guide beads according to present invention are integrated in the overall structure the small amount of additional material that is needed to make the beads solid provides a much stronger general structure as well as much stronger guide beads and is therefore more than justified.

Preferably, internal longitudinal grooves or tracks 17 extend essentially along the centre of the side walls 13, 14. The tracks 17 are adapted for guiding the movement of a drive mechanism 24 involved in driving the drilling machine 5. As may be seen in FIG. 3, the drive mechanism 24 in the preferred embodiment includes sheaves 25, 26 that are driven back and forth inside the feed beam 4. The tracks 17 are adapted to guide the drive mechanism 24 with attached sheaves 25, 26 so that they may glide back and forth with a minimum of deviation and without getting stuck. Also, the exterior parts 27 of the pressure cylinder 7 is adapted to mate with the interior of the beam 4, including the tracks 17, whereby the tracks assist in holding the pressure cylinder 7 in place. Additionally, the tracks 17 have a third purpose in that they allow for the feed beam to be lighter, as material can be saved in the making of it, once again without essentially weakening the structure.

The feed beam is preferably produced from an extruded aluminium beam. The basic material for extruded aluminium profiles is alloyed aluminium billets. The billets are cut into work pieces of suitable lengths and are warmed up to a temperature of about 450-500° C. before they are forced through a die with the appropriate profile. The finished profile runs out of the die almost like a tooth paste out of a tube. The profiles are generally extruded at a speed of 5-50 metres per minute and can be as long as 50 metres. Naturally a beam produced in this way has an invariable cross section along its whole length.

Thereafter the profiles are sawn into required lengths, a feed beam is typically between 4 and 12 metres long. The full strength of the material is usually achieved through a few hours' heat treatment, or thermal ageing, in a furnace. Cold ageing is also possible, and makes the material harder. Generally it is however appreciable that the feed beam is not made too hard as a moderate resiliency in the beam increases the ductility and the absorption of vibrations.

The production of hollow aluminium profiles is more complicated than the production of other profiles. In order to produce a hollow extruded article the die needs to include at least two parts, one core part and one outer part. The core part is needed for creation of the hole and the outer part forms the outer profile.

The possibility to produce a useful profile is one of the most important differences from conventional steel beams. On these beams guide beads for the drilling machine had to be welded on to the beam. This caused a number of problems. First of all it is very difficult to produce a straight weld of such length, which is a requirement if the drilling machine is to slide smoothly along the feed beam. A second problem is that the weld in itself may not be as resistant to exterior forces as the rest of the structure. It is also difficult to adapt the form of the guide beads to specific needs when they need to be welded on to the feed beam.

On extruded aluminium feed beams the beads may be made integral with the beam, which both strengthens the overall construction and offers a greater liberty in the constructional shaping of e.g. the guide beads. As mentioned above an extruded aluminium feed beam is thicker than a conventional feed beam of steel. The thickness of the beam may however be an advantage as it makes it possible for auxiliary equipment to be screwed on to the beam, instead of as for conventional beams where all auxiliary equipment needed to be welded on to the beam. The reason for this is that the aluminium feed beam has a thickness that allows for a sufficient number of threads to hold a bolt, which the steel feed beam did not.

The use of extruded aluminium profiles as feed beams presents a large number of advantages compared to conventional feed beams that are made of steel.

Aluminium feed beams are lighter.

Aluminium feed beams can be made more resilient.

Aluminium feed beams are straighter.

The profile of aluminium feed beams can easily be adapted to specific needs without having to weld or in other ways attach parts to the structure.

Another advantage of an aluminium feed beam is of course its resistance to corrosion, which is due to passivating of the surface layer of the aluminium when exposed to air, whereby $Al_2O_3$ is formed. The passivated aluminium layer protects the aluminium from further oxidation. However, part of the $Al_2O_3$-layer may come loose if subjected to heavy wear, whereby the aluminium beneath will be exposed to air. Whenever this happens a new protective $Al_2O_3$-layer will form and protect the aluminium from further oxidation. However, in order to avoid that guide beads are worn down due to the sliding cradle upon them they are preferably provided with protective bent steel plates that are snapped on to the beads. A problem with these bent plates is however that they are difficult to replace when they get worn down as the drilling machine needs to be removed before the plates may be replaced. In a preferred embodiment of this invention the plates on the guide beads 8, 9 consist of at least two shorter plates such that the it suffices to place the drilling machine at one end of the feed beam 4 to be able to replace the plate at the other end. When the first plate has been replaced the drilling machine may be moved onto the new plate at the other end of the beam so that the plate at the first end may be replaced. It has been discovered that no specific joint is needed between two plates. As long as adjacent plates are kept closely together the drilling machine may slide smoothly over the splice between them. Hence, the bent plates are preferably kept butt to butt.

The invention claimed is:

1. Elongated rock drill rig feed feed beam (4), the feed beam comprises a profiled box beam of a light metal or a light metal alloy made from a hollow extruded profile with a substantially rectangular cross section with an upper wall, a lower wall and two side walls, the upper, lower and side walls of the feed beam having substantially planar outer surfaces, the feed beam including at least two pair of external individual guide beads (8, 9), wherein one of said two pair of external guide beads (8) guiding movement of a rock drilling machine (5) or a sled (15) on which a drilling machine is placed along the beam (4), the other of said two pair of external guide beads (9) guiding the movement of the feed beam (4) with respect to a feed beam holder (3); wherein said individual external guide beads of said one pair of guide beads (8) are placed on opposite sides of the upper wall (11) at locations where the upper wall meets said side walls (13, 14) and said individual external guide beads of said other pair of guide beads (9) are placed on opposite sides of the lower wall (12) at the locations where said lower wall meets said side walls (13, 14) such that said individual external guide beads are positioned at each corner of said hollow extruded profile, each of the individual external guide beads (8, 9) being configured in a substantially prismatic cross section so as to absorb forces tending to rotate the drilling machine relative to the feed beam, each of said individual external guide beads being integrally formed with said feed beam, and wherein internal longitudinal tracks (17) extend essentially along the centre of the side walls (13, 14), the tracks (17) being adapted for guiding a drive mechanism (24) involved in driving the rock drilling machine (5).

2. Elongated rock drill rig feed feed beam (4) according to claim 1, wherein each guide bead (8, 9) is solid and has two substantially planar support surfaces (21, 22) that are joined by an edge (23) and inclined with respect to each other with an angle ($\theta$) of 45° to 100°, such that the edge (23) constitutes the outermost parts of the beads (8, 9), the support surface (21, 22) forming supports upon which the rock drilling machine (5) or the sled (15) on which the drilling machine (5) is placed may glide along the feed beam (4).

3. Elongated rock drill rig feed feed beam (4) according to claim 2, wherein the feed beam is formed with an invariable cross section.

4. Elongated rock drill rig feed feed beam (4) according to claim 2, wherein the feed beam is formed from an extruded aluminum profile or an aluminum alloy profile.

5. Elongated rock drill rig feed feed beam (4) according to claim 2, wherein the support surfaces (21, 22) are inclined with respect to each other with an angle (θ) of 80° to 100°.

6. Elongated rock drill rig feed feed beam (4) according to claim 5, wherein external longitudinal recesses (18) extend alongside the guide beads (8, 9) on both side walls (13, 14), said recesses (18) defining a groove between the side walls (13, 14) and the guide beads (8, 9).

7. Elongated rock drill rig feed feed beam (4) according to claim 6, wherein internal longitudinal bulges (19) extend inside the feed beam (4) on both side walls (13, 14), said bulges (19) being located such that they at least partly overlap said external longitudinal recesses (18) on the other side of the same side wall (13, 14).

8. Elongated rock drill rig feed feed beam (4) according to claim 2, wherein external longitudinal recesses (18) extend alongside the guide beads (8, 9) on both side walls (13, 14), said recesses (18) defining a groove between the side walls (13, 14) and the guide beads (8, 9).

9. Elongated rock drill rig feed feed beam (4) according to claim 8, wherein internal longitudinal bulges (19) extend inside the feed beam (4) on both side walls (13, 14), said bulges (19) being located such that they at least partly overlap said external longitudinal recesses (18) on the other side of the same side wall (13, 14).

10. Elongated rock drill rig feed feed beam (4) according to claim 9, wherein internal longitudinal recesses (20) extend inside the feed beam on both side walls, said recesses (20) being located such that they at least partly overlap the guide beads (8, 9) on the other side of the same side wall (13, 14).

11. Elongated rock drill rig feed feed beam (4) according to claim 8, wherein internal longitudinal recesses (20) extend inside the feed beam on both side walls, said recesses (20) being located such that they at least partly overlap the guide beads (8, 9) on the other side of the same side wall (13, 14).

12. Elongated rock drill rig feed feed beam (4) according to claim 1, wherein the feed beam is formed with an invariable cross section.

13. Elongated rock drill rig feed feed beam (4) according to claim 1, wherein the feed beam is formed from an extruded aluminum profile or an aluminum alloy profile.

14. Elongated rock drill rig feed feed beam (4) according to claim 1, wherein the substantially rectangular cross section of the feed beam has a plane of symmetry ($P_{s1}$) that intersect the centre of the upper (11) and lower (12) walls such that the side walls (13, 14) constitute mirror images of each other.

15. Drill rig (1) comprising an elongated rock drill rig feed feed beam (4) according to claim 1.

* * * * *

UNITED STATES PATENT AND TRADEMARK OFFICE

CERTIFICATE OF CORRECTION

PATENT NO. : 8,393,790 B2
APPLICATION NO. : 11/921036
DATED : March 12, 2013
INVENTOR(S) : Rene Deutsch and Dan Jonsson It is certified that error appears in the above-identified patent and that said Letters Patent is hereby corrected as shown below:

In the Claims:

Col. 6, lines 25-66 and Col. 7, lines 1-27 and Col. 8, lines 1-21

Claims 1-14, Line 1: Delete “feed” (second occurrence).

Col. 8, lines 22-23

Claim 15, Line 2: Delete “feed”.

Signed and Sealed this
Seventh Day of May, 2013

Teresa Stanek Rea
*Acting Director of the United States Patent and Trademark Office*